United States Patent [19]

Sudnishnikov et al.

[11] 3,942,595

[45] Mar. 9, 1976

[54] SELF-PROPELLED PERCUSSIVE MACHINE FOR BORING HOLES

[76] Inventors: Boris Vasilievich Sudnishnikov, Krasny prospekt, 56, kv. 59; Veniamin Viktorovich Kamensky, ulitsa Derzhavina, 19, kv. 70; Eduard Petrovich Varnello, ulitsa Dzerzhinskogo, 3, kv. 19; Sergei Konstantinovich Tupitsyn, ulitsa Zorge, 123, kv. 31, all of Novosibirsk, U.S.S.R.

[22] Filed: Nov. 14, 1974

[21] Appl. No.: 523,798

[52] U.S. Cl. ..... 175/99; 173/72; 175/230

[51] Int. Cl.[2] ..... E21B 1/06

[58] Field of Search ..... 175/99, 230, 94, 97, 98; 173/72

[56] References Cited

UNITED STATES PATENTS

| | | | |
|---|---|---|---|
| 2,819,038 | 1/1958 | Eckel | 175/99 |
| 3,326,305 | 6/1967 | Garrett et al. | 175/230 X |

*Primary Examiner*—Ernest R. Purser

*Attorney, Agent, or Firm*—Haseltine, Lake & Waters

[57] ABSTRACT

A percussive machine having an impact mechanism accommodated to a housing with a hammer piston imparting blows to a rock-destroying member. There is provided an air-supply duct for supplying compressed air to the impact mechanism and to the hole face. In order to prevent the machine from moving away from the hole face during the operation, the housing is provided with an elastic tubular member having a space in constant communication with the air supply duct.

5 Claims, 5 Drawing Figures

SELF-PROPELLED PERCUSSIVE MACHINE FOR BORING HOLES

The present invention relates to percussive machines for boring holes in rocks of different hardness, and in particular to self-propelled percussive machines for boring holes.

The machine according to the invention may be used in mining, construction and industries, where it is required to bore a hole in restricted site conditions when conventional boring equipment cannot be employed because of the size and weight limitations.

Known in the art is a self-propelled percussive machine for boring holes in rocks comprising a housing with an impact mechanism accommodated therein having a hammer piston imparting blows to a rock-disintegrating member, means for preventing the machine from moving away from the hole face during the operation and, an air-supply duct for supplying compressed air to the impact mechanism and to the hole face for removing rock disintegration products from the hole.

In this machine, the means preventing the machine from moving away from the hole face during the operation comprises a plurality of steel plates articulated to the rear end of the machine housing. The edges of the plates facing the borehole wall are provided with indents. In the working position of the machine, the plates engage the borehole wall under the action of a spring mechanism which is also mounted on the rear end of the machine between the plates. There are also provided ropes, each having one end secured to the plate, the other end being outside the borehole. These ropes are used to disengage the plates from the borehole wall and to withdraw the machine from the borehole.

However, the means preventing the machine from moving away from the hole face has a complicated construction, while the force of engagement thereof with the borehole wall is unstable if irregularities occur on this wall. Furthermore, this means cannot automatically disengage from the borehole wall upon interrupting the boring, and an additional external force is to be applied to the cables of such means which should be sufficient to overcome the resistance of elastic forces of the spring mechanism. This force should be maintained constant during the entire period of withdrawl of the machine from the borehole, because otherwise an undesired engagement of the machine with the borehole wall will again occur.

In addition, such means for engaging the borehole wall is unreliable in operation due to the large number of parts and their joints (articulations, threaded connections and cam links) while the service life of the machine is also short for the same reason.

Attempts were made to provide a self-propelled percussive machine for boring holes having a walking-type means preventing the machine from moving away from the hole face, in combination with a complicated air-distribution device, impact mechanism and means for turning the rock-disintegrating member.

Such conventional machines have not found a wide application heretofore because of their complicated construction, unreliable operation and limited performance inherent to the machines with a turnable rock-destroying member (due to a small size).

It is an object of the invention to provide a self-propelled percussive machine for boring holes which is more reliable in operation.

Another object of the invention is to provide a self-propelled machine having a more stable force of engagement with the borehole wall.

Still another object of the invention is to provide a self-propelled machine with means preventing the machine from moving away from the hole face during the operation having of simpler construction as compared to such means used in known machines of the same type.

These and other objects of the invention are accomplished by the provision of a self-propelled percussive machine for boring holes in rocks comprising a housing with an impact mechanism accommodated therein having a hammer piston imparting blows to a rock-destroying memmber, means preventing the machine from moving away from the hole face during the operation, an air-supply duct for supplying compressed air to the impact mechanism and to the hole face to remove rock disintegration products from the borehole, wherein, according to the invention, the means for preventing the machine from moving away from the hole face comprises an elastic tubular member mounted on the housing and having a space in permanent communication with the air-supply duct.

The working section of the tubular member preferably is of an oval shape. This shape of the tubular member contributes to the application of an increased normal pressure force to the borehole wall.

The tubular member is preferably externally provided with plates mounted thereon, which are made of a material resistant to abrasive wear. This prolongs the service life of the tubular member and improves the reliability of the machine as a whole.

According to the invention there is provided a self-propelled machine having an improved reliability in operation, more stable engagement with the borehole wall, a rather simple structure and more durable means preventing the machine from moving away from the hole face.

The invention will now be described with reference to a specific embodiment thereof illustrated in the accompanying drawings, in which.

Figure 1:
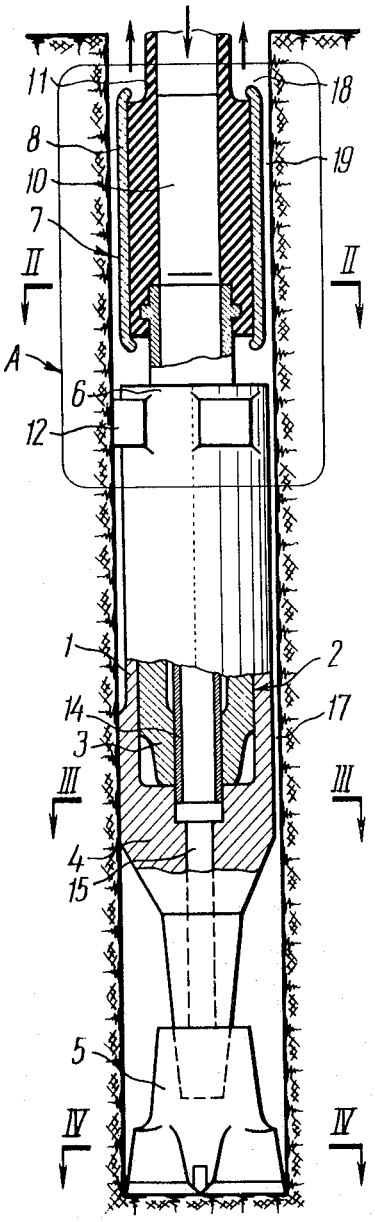
FIG. 1 is a front elevation view partially in section of a self-propelled percussive machine for boring holes according to the invention.

The specific embodiment of the invention shown in the drawings will be described using the specific narrow terms of the art. It should be, however, borne in mind that each term covers all possible equivalents performing identical functions and used for similar purposes.

A self-propelled percussive machine for boring holes is shown in FIGS. 1. to 5 and comprises a housing 1 with an impact mechanism 2 accommodated therein. A hammer piston 3 of this mechanism imparts, via a forward part 4 of the housing 1, impact pulses to a rock-destroying member 5 fitted on the housing (impact pulses can be imparted directly to the rock-destructing member).

The top portion of the machine 6 is provided with means preventing the machine from moving away from the hole face during the operation which comprises an elastic tubular member 7 made, for example, from rubber. The elastic member is externally provided with metal plates 8 mounted thereon so as to improve the resistance of this means against abrasive wear, and openings 9 are made in the elastic member to pass rock disintegration products from the bore hole.

The internal space 10 of the member 7 has a working section of oval shape. This shape of the working section provides for application of an increased force of engagement of the elastic member with the borehole wall.

The internal space 10 of the member 7 is in permanent communication with an air supply duct 11 which serves for supplying compressed air to the machine and to the hole face for removing rock disintegration products from the borehole. The duct 11 is integral with the elastic member.

In order to reduce cambering of the borehole, the housing 1 is provided with guides 12 and 13.

A pipe 14 extends through the impact mechanism 2 which is connected to the air-supply duct 11. This pipe, as well as a passage 15 made in the forward part 4 of the housing 1 and connected to the pipe, are used to provide the supply of compressed air to the hole face for blasting independently of the operation of the machine.

Since the impact mechanism 2 is not claimed herein and may be of any appropriate known type (valveless, valve-type and the like) with various modifications of the air supply duct configuration, it will not be described in details.

In order to enable the removal of rock disintegration products from the borehole, the rock-destroying member 5 has a passage formed by openings 16 leading to a passage 17 between the housing 1 of the machine and the borehole wall, and a passage 18 between the air-supply duct 11 and the borehole wall.

When in the inoperative position, a space 19 is provided between the tubular member 7 and the borehole wall. The engagement of the member 7 with the borehole wall is effected through the intermediary of projections 20.

The self-propelled machine may be either reversible or non-reversible. Reverse operation may be achieved by using a widely known reverse means employed in self-propelled air-operated percussive machines for boring holes by compacting soil.

When the machine is non-reversible, it can be withdrawn from the borehole, for example, by using ropes fixed to the machine housing 1.

In boring horizontal holes, the machine launched from one well will appear in the other from the resulting borehole.

The method of withdrawing the machine is not relevant to the invention, and, therefore, it will not be considered herein in detail.

Figure 2:
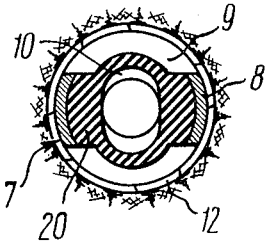
FIG. 2 is a sectional view taken along line II—II in FIG. 1.
Figure 3:
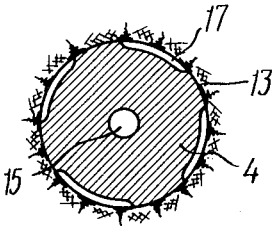
FIG. 3 is a sectional view taken along line III—III in FIG. 1.
Figure 4:
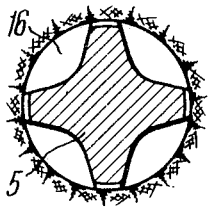
FIG. 4 is a sectional view taken along line IV—IV in FIG. 1.
Figure 5:
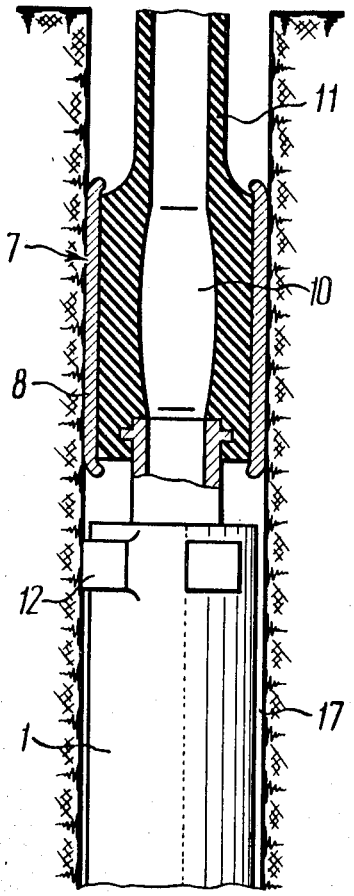
FIG. 5 is a detail A in FIG. 1 (showing means preventing the machine from moving away from the hole face when engaged with the borehole wall).

The self-propelled percussive machine for boring holes shown in FIGS. 1 to 5 operates as follows:

In the initial position of the machine shown in FIGS. 1, 2 the means for preventing the machine from moving away from the hole face is disposed in the borehole or in a launching pipe with the space 19.

Upon feeding compressed air into the air-supply duct 11, the air is admitted into the internal space 10 of the elastic tubular member 7.

Since the working section of the member 7 is of an oval shape, the compressed air pressure applied to the projections 20 arranged on the oval surfaces of the member with a larger radius of curvature will be greater, while the projections will be urged against the borehole walls with a greater force, than a force which could be developed with a round working section of the elastic member.

The force of engagement of the projections with the borehole walls is a calculated value. It should correspond to the value of the recoil forces of the machine, and in order to prevent the machine from moving away from the hole face, this force should be at least equal to the recoil forces.

The compressed air flows further from the elastic tubular member 7 into the machine housing 1 to the impact mechanism 2, and concurrently, via the pipe 14 and the passage 15 in the forward part 4 of the machine, for blasting the face.

When the compressed air enters the impact mechanism 2, the hammer piston 3 starts reciprocating to impart blows at the forward part 4 of the housing 1 so as to transmit impact pulses to the rock-destroying member 5 mounted on the forward part 4 of the housing 1. The rock-destroying member 5 will penetrate the hole face to destroy the rock.

As the depth of penetration of the rock-destroying member in the rock increases, the machine housing 1, together with the elastic tubular member 7 mounted thereon, will also move at the same depth of the borehole being formed due to the fact that the blow force exerted by the hammer piston 3 on the forward part 4 of the housing 1 is greater than the force of engagement of the tubular member 5 with the borehole wall.

Thus, the machine moves in the borehole without the application of any axial force which should be generally exerted by a combersome rig mounted on the ground surface.

Rock disintegration products are removed through the openings 16 of the rock-destroying member 5, passages 17, openings 9 and annular space 18 by the compressed air supplied to the hole face as described above.

It should be noted that the invention may be also used when supplying the machine with an air-water mixture or liquid, as well as with a combined electric and pneumatic power supply.

What is claimed is:

1. A self-propelled percussive machine for boring holes in rocks comprising: a housing; an impact mechanism accomodated in said housing and having a reciprocating hammer piston; a rock-destroying member mounted on the forward part of said housing, the hammer piston of said impact mechanism imparting impact pulses to said rock-destroying member during its reciprocation; an air-supply duct for supplying compressed air both to said impact mechanism for operating it and to the hole face for removing rock disintegration products from the borehole; means for preventing said self-propelled machine from moving away from the hole face during the operation, said means being mounted on said housing and comprising an elastic tubular member having an internal space in permanent communication with said air-supply duct, said elastic tubular member including radial projections and being deformed under the action of the compressed air to urge said radial projections against the borehole wall thus preventing the self-propelled machine from moving away from the hole face during the operation, said tubular member defining a clear space with the wall of the hole which space is permanently open during the operation, said housing defining an open passage with the wall of the hole leading to said clear space so that rock particles can flow continuously from the hole via said passage and clear space under the action of the compressed air.

2. A self-propelled machine as claimed in claim 1 wherein said air supply duct is integral with said elastic tubular member.

3. A self-propelled machine as claimed in claim 1, wherein said elastic tubular member is of oval shape.

4. A self-propelled machine as claimed in claim 1, comprising plates on said projections made of a material resistant to abrasive wear.

5. A self-propelled machine as claimed in claim 1 wherein said projections have outer surfaces which are curved as ring segments.

* * * * *